US006546656B2

(12) United States Patent
Twentier

(10) Patent No.: US 6,546,656 B2
(45) Date of Patent: Apr. 15, 2003

(54) METHOD AND APPARATUS FOR ADJUSTABLY SIZING IDENTIFICATION BAND

(76) Inventor: Carl R. Twentier, 2320 W. Holly St., Phoenix, AZ (US) 85009

( * ) Notice: Subject to any disclaimer, the term of this patent is extended or adjusted under 35 U.S.C. 154(b) by 0 days.

(21) Appl. No.: 09/738,453

(22) Filed: Dec. 15, 2000

(65) Prior Publication Data

US 2002/0073587 A1 Jun. 20, 2002

(51) Int. Cl.[7] ..... A44C 5/00; G09F 3/14
(52) U.S. Cl. ..... 40/633; 40/665; 63/3.1
(58) Field of Search ..... 40/6, 633, 665; 63/3, 3.1; 283/75, 107, 109; 292/307 A

(56) References Cited

U.S. PATENT DOCUMENTS 3,197,899 A * 8/1965 Twentier ..... 40/633
4,078,324 A * 3/1978 Wiebe ..... 40/665
4,314,415 A * 2/1982 De Woskin ..... 40/633

FOREIGN PATENT DOCUMENTS

EP 71933 * 2/1982 ..... 40/633

* cited by examiner

*Primary Examiner*—Brian K. Green
(74) *Attorney, Agent, or Firm*—Tod R. Nissle, P.C.

(57) ABSTRACT

An identification band and method for fitting the same to an individual's wrist. The ends of the band overlap when the band is applied around an individual's wrist. The band is constructed so the band can be adjusted to fit different sizes of wrists and allow the end to overlap without requiring that one of the ends be cut to size the band.

4 Claims, 2 Drawing Sheets

FIG. 3
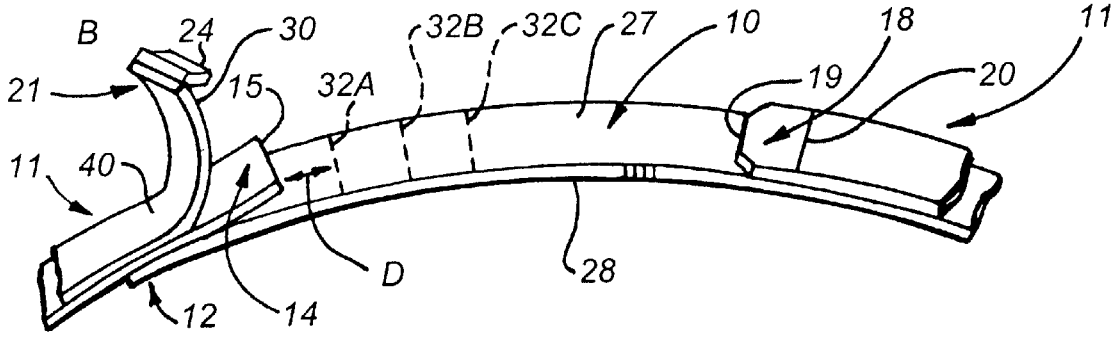
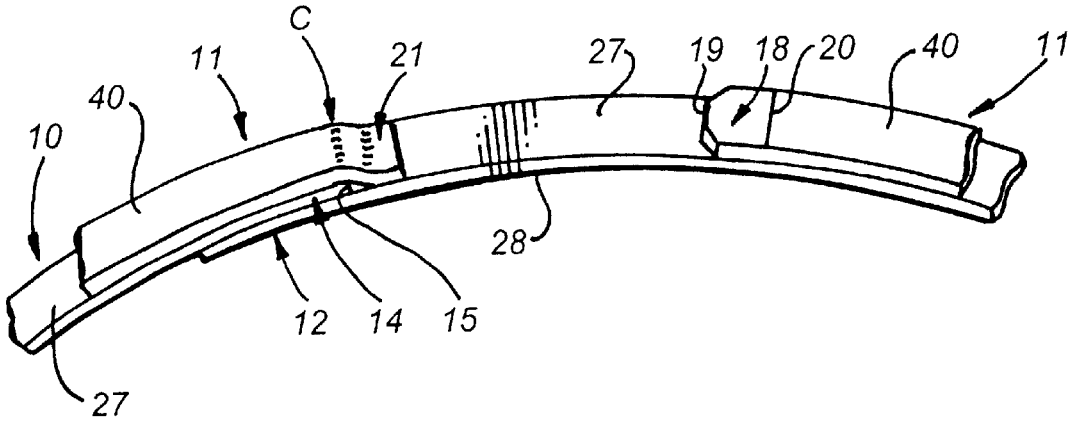
FIG. 4

METHOD AND APPARATUS FOR ADJUSTABLY SIZING IDENTIFICATION BAND

CROSS-REFERENCES TO RELATED APPLICATIONS

Not Applicable.

Statement Regarding federally Sponsored Research or Development.

Not Applicable.

Reference to a "Microfiche Appendix" (see 37 CFR 1.96).

Not Applicable.

BACKGROUND OF THE INVENTION

1. Field of the Invention

This invention pertains to identification bands.

More particularly, this invention pertains to a method and apparatus for fitting an identification band on the wrist of a patient.

2. Description of the Related Art Including Information Disclosed Under 37 CFR 1.97 and 1.98

U.S. Pat. No. 3,197,899 to Twentier describes an identification band. The band includes a first strip of flexible material having first and second ends. The strip is looped around the wrist of a patient such that the second end overlaps the top of the first end. The top of the first end is provided with adhesive which contacts the second end and secures the second end in place on the adhesive. One end of a second strip of transparent material is affixed to the top of the middle of the first strip. The other end of the strip of transparent material overlaps the second end of the first strip to help further secure the second end of the first strip in position on the first end of the first strip. The second strip of material only extends intermediate the ends of the first strip of material and does not extend outwardly past the ends of the first strip.

While the identification band utilized in the Twentier patent has been in use for many years, it suffers from a significant disadvantage. Namely, the second end of the first strip must be attached to a specific area on top of the first end of the first strip. This means that when the band is sized to fit a smaller sized wrist, the second end of the strip must be cut to size. While carrying scissors and cutting the Twentier band to size is readily accomplished, it is an inconvenient and time-consuming procedure, particularly in hospitals or medical treatment facilities where large numbers of patients are processed and where many medical personnel are involved in applying bands to patients.

Accordingly, it would be highly desirable to provide an improved identification band which could be sized without requiring the use of scissors.

Therefore, it is a principal object of the invention to provide an improved identification band.

Another object of the invention is to provide an improved identification; band of the general type described in U.S. Pat. No. 3,197,899 to Twentier which can be readily adjusted to fit different sized wrists without requiring that the identification band be cut.

BRIEF SUMMARY OF THE INVENTION

Briefly, in accordance with the invention, I provide an improved method for adjusting an identification band to fit around a wrist of a patient without requiring that the band be cut to size. The method includes the step of providing a first strip of flexible material having a top surface; a bottom surface; a first end; a second end; and, an intermediate portion extending between the first and second ends. The method also includes the step of providing a second strip of flexible material including a first end; a second end; an upper surface; a lower surface; and, a transparent section comprising at least a portion of the second strip. The method further includes the steps of attaching the second end of the second strip to the intermediate portion and the top surface of the first strip such that the second strip extends over a section of the first strip, and a portion of the first end of the second strip extends outwardly past and away from the first end of the first strip; wrapping the first strip around the wrist such that the first end overlaps the second end, and the bottom surface is adjacent the wrist; adjusting the position of the first end of the first strip on the second end of the first strip to fit the band to the wrist; attaching the first end of the first strip to the second end of the first strip; and, attaching the portion of the first end of the second strip to the top surface of the first strip in overlapping relationship to the first end of the second strip to secure the band around the wrist.

In accordance with another embodiment of the invention, I provide an improved identification band for adjustment to fit around a wrist of a patient without requiring that the band be cut to size. The band includes a first strip of flexible material having a top surface; a bottom surface; a first end; a second end; and, an intermediate portion extending between the first and second ends. The band also includes a second strip of flexible material including a first end; a second end; an upper surface; a lower surface; and, a transparent section comprising at least a portion of the second strip. The second end is attached to the intermediate portion and the top surface of the first strip such that the second strip extends over a section of the first strip; and, a portion of the first end of the second strip extends outwardly past and away from the first end of the first strip. The portion of the first end of the second strip is attached to the top surface of the first strip in overlapping relationship to the first end of the second strip.

BRIEF DESCRIPTION OF THE SEVERAL VIEWS OF THE DRAWING(S).

The foregoing and other, further and more specific objects and advantages of the invention will be apparent from the following detailed description of the invention, taken in conjunction with the drawings, in which.

DETAILED DESCRIPTION OF THE INVENTION

Figure 1:
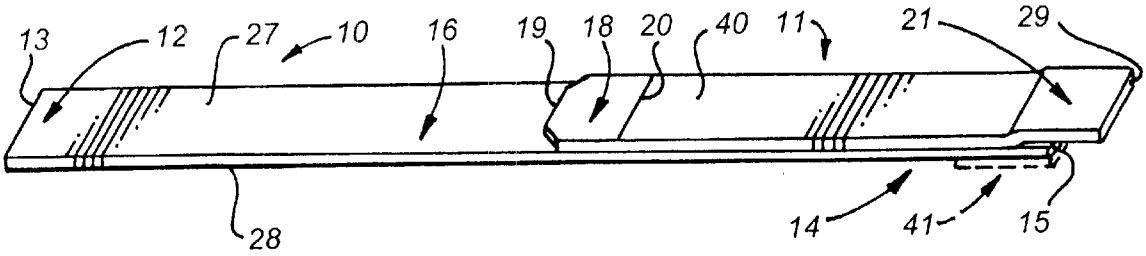
FIG. 1 is perspective view illustrating an identification band constructed in accordance with the principles of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 4 illustrate an identification band including a first strip of a polymer or other flexible material 10 and a second strip of a flexible transparent polymer or other transparent flexible material 11.

The strip 10 includes a top rectangular-shaped surface 27, bottom rectangular-shaped surface 28, first end 14, second end 12, intermediate portion 16 extending between ends 12 and 14, and edges 13 and 15 on ends 12 and 14, respectively. Information for identifying a patient or any other desired information is written or imprinted on upper surface 27 in the area circumscribed by dashed lines 31. Or, a label bearing the patient's name or bearing other desired information can be fastened to surface 27 with adhesive or other fastening means. If desired, adhesive 41 can be attached to surface 28 of end 14. Adhesive 41 can be contact adhesive and be covered and protected by a backing which can be peeled off adhesive 41 to expose adhesive 41.

The strip 11 includes first end 21, second end 18, crease or line of weakening 20, upper rectangular surface 40, a lower rectangular surface, contact adhesive 30 (FIG. 2) applied to the lower surface, and backing tape strip 23 (FIG. 2) removably attached to adhesive 30. Strip 11 is shaped and dimensioned such that a portion of first end 21 extends outwardly past and away from end 14 and edge 15. This extension of end 21 outwardly from strip 10 is important in the practice of the invention.

Figure 2:
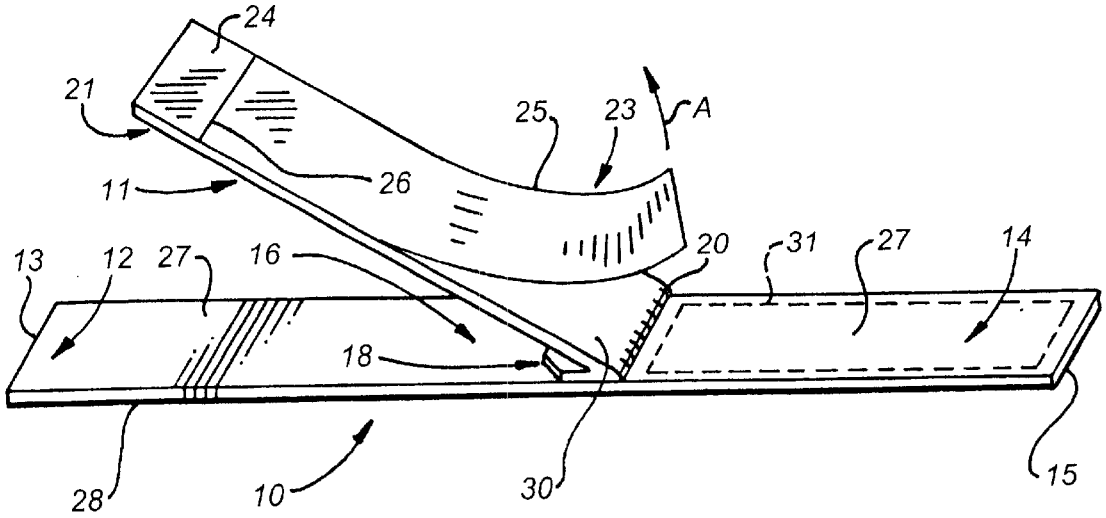
FIG. 2 is perspective view illustrating the mode of operation of the identification band of FIG. 1; to FIG. 3 is a perspective view further illustrating the mode of operation of the identification band of FIG. 1; and, FIG. 4 is a perspective view still further illustrating the mode of operation of the identification band of FIG. 1.

Strip 23 includes sections 24 and 25 separated by die cut 26 extending through strip 23 (FIG. 2). Section 25 is removed by peeling it off adhesive 30 in the direction of arrow A. Section 24 is similarly removed from adhesive 30. After patient identification information is inscribed on or applied to area 31 of surface 27, section 25 is removed from adhesive 30, strip 11 is returned to the position shown in FIG. 1, and is pressed against strip 10 to secure adhesive 30 to strip 10.

In use, flexible strip 11 is folded along line of weakening 20 and moved from the position of FIG. 1 to the position of FIG. 2. Patient identification information or other information is inscribed on or applied to area 31. Section 25 is peeled in the direction of arrow A off adhesive 30. Strip 11 is moved from the orientation of FIG. 2 back to the position shown in FIG. 1 and is pressed against surface 27 to affix adhesive 30 to a portion of surface 27 intermediate end 18 and edge 15. Strip 11 covers and protects the information inscribed in or applied to area 31. Strip 10 is wrapped around the wrist of a patient such that first end 14 overlaps second end 12 in the manner illustrated in FIG. 3. The position of end 14 is adjusted along surface 27 in the directions indicated by arrows D to fit the band to the wrist of the patient. The band can loosely fit, snugly fit, etc. the wrist as desired. By way of example, and not limitation, end 14 can be slid over end 12 until edge 15 is in the position indicated by dashed line 32A or is in the position indicated by dashed line 32B or is in the position indicated by dashed line 32C.

Once the position of end 14 on and over end 12 is selected, section 24 is peeled off the remaining section of adhesive 30 in the direction indicated by arrow B in FIG. 3, and end 21 is pressed downwardly in the direction of arrow C in FIG. 4 against end 14 and against a portion of surface 27 adjacent edge 15 of end 14. The overlapping of end 21 with respect to edge 15 is important in the practice of the invention because it functions to secure end 14 in fixed position. Although not necessary, it is preferred that a portion of the adhesive 30 beneath end 21 contact and adhere to the portion of top surface 27 comprising the top of end 14, When this is accomplished, end 21 adheres to and secures both end 14 and a portion of surface 27 adjacent end 14. Similarly, the portion of bottom surface 28 comprising the lower portion of end 14 can be fastened to the portion of top surface 27 comprising the upper surface of end 12 in FIG. 4. This is, for example, accomplished if end 14 is provided with adhesive 41 in the manner earlier described.

In contrast to the identification band described in U.S. Pat. No. 3,197,899, the improved identification band of the invention requires that end 14 overlap end 12 and not vice-versa, requires that the position of end 14 along surface 27 and with respect to end 12 be adjustable, and requires that the end 21 of flexible strip 11 extend outwardly past edge 15 of end 14.

Having described my invention in such terms as to enable those of skill in the art to make and practice it, and having described the presently preferred embodiments thereof, I claim:

1. A method for adjusting an identification band to fit around a wrist of a patient without requiring that the band be cut to size, said method including the steps of (a) providing a first strip of flexible material having
  (i) a top surface,
  (ii) a bottom surface,
  (iii) a first end,
  (iv) a second end, and
  (v) an intermediate portion extending between said first and second ends;

(b) providing a second strip of flexible material including
  (i) a primary fastener end,
  (ii) a secondary end,
  (iii) an upper surface,
  (iv) a lower surface,
  (v) adhesive on said lower surface,
  (vi) a backing removably attached to said adhesive, and
  (vii) a transparent section comprising at least a portion of said second strip;

(c) attaching said secondary end of said second strip to said intermediate portion and said top surface of said first strip such that
  (i) said second strip extends over only a portion of said first strip, and
  (ii) a portion of said primary fastener end of said second strip, said adhesive on said portion of said primary fastener end, and said backing on said portion of said primary fastener end extend
    over said top surface on said first end of said first strip, and
    outwardly past and away from said first end of said first strip;

(d) wrapping said first strip around the wrist such that
  (i) said first end overlaps said second end such that said bottom surface on said first end contacts said top surface on said second end, and
  (ii) a portion of said bottom surface of said first strip is adjacent and contacts the wrist;

(e) adjusting the position of said first end of said first strip along said second end of said first strip to fit the band to the wrist;

(f) attaching said first end of said first strip to said second end of said first strip.

2. The method of claim 1 wherein in step (f), (a) said backing on said primary fastener end is removed from said adhesive on said primary fastener end, and (b) said adhesive on said primary fastener end contacts said top surface on said first end and said top surface on said second end to secure said first end of said first strip to said second end of said first strip.

3. A method for adjusting an identification band to fit around a wrist of a patient without requiring that the band be cut to size, said method including the steps of (a) providing a first strip of flexible material having
(i) a top surface,
(ii) a bottom surface,
(iii) a first end,
(iv) a second end, and
(v) an intermediate portion extending between said first and second ends;

(b) providing a second strip of flexible material including
(i) a primary fastener end,
(ii) a secondary end,
(iii) an upper surface,
(iv) a lower surface,
(v) adhesive on said lower surface,
(vi) a backing removably attached to said adhesive, and
(vii) a transparent section comprising at least a portion of said second strip;

(c) attaching said secondary end of said second strip to said intermediate portion and said top surface of said first strip such that
(i) said secondary end is spaced apart from said second end,
(ii) said second strip extends over only a portion of said first strip, and
(iii) a portion of said primary fastener end of said second strip, said adhesive on said portion of said primary fastener end, and said backing on said portion of said primary fastener end extend
over said top surface on said first end of said first strip, and
outwardly past and away from said first end of said first strip;

(d) wrapping said first strip around the wrist such that
(i) said first end overlaps said second end such that said bottom surface on said first end contacts said top surface on said second end, and
(ii) a portion of said bottom surface of said first strip is adjacent and contacts the wrist;

(e) adjusting the position of said first end of said first strip along said second end of said first strip to fit the band to the wrist;

(f) removing said backing from said primary fastener end;

(g) attaching: said first end of said first strip to said second end of said first strip by pressing said adhesive on said portion of said primary fastener end against both
said top surface on said first strip intermediate said secondary end and said second end, and
said top surface on said first end.

4. An identification band for adjustment to fit around a wrist of a patient without requiring that the band be cut to size, said band including (a) a first strip of flexible material having
(i) a top surface,
(ii) a bottom surface,
(iii) a first end,
(iv) a second end, and
(v) an intermediate portion extending between said first and second ends;

(b) a second strip of flexible material including
(i) a primary fastener end,
(ii) a secondary end attached to said top surface of said intermediate portion such that said secondary end is spaced apart from said second end and said second strip extends over only a portion of said first strip,
(iii) an upper surface,
(iv) a lower surface,
(v) adhesive on said lower surface,
(vi) a backing removably attached to said adhesive, a portion of said primary fastener end of said second strip, said adhesive on said portion of said primary fastener end, and said backing on said primary fastener end extending
over said top surface on said first end of said first strip, and
outwardly past and away from said first strip and said first end of said first strip such that when
said first end overlaps said second end,
said bottom surface on said first end contacts said top surface on said second end intermediate said secondary end and said second end, and said backing is removed,
said adhesive oh said primar fastener end contacts said top surface on said first end and said top surface on said second end.

* * * * *